US008267448B2

(12) United States Patent
Dagenais et al.

(10) Patent No.: US 8,267,448 B2
(45) Date of Patent: Sep. 18, 2012

(54) CAM ARM ACTUATED BACKUP TONG

(75) Inventors: Dan Dagenais, Edmonton (CA); Murray Gerwing, Edmonton (CA); Steven Hargreaves, St. Albert (CA)

(73) Assignee: McCoy Corporation, Edmonton, Alberta (CA)

( * ) Notice: Subject to any disclaimer, the term of this patent is extended or adjusted under 35 U.S.C. 154(b) by 3 days.

(21) Appl. No.: 12/770,927

(22) Filed: Apr. 30, 2010

(65) Prior Publication Data

US 2010/0276954 A1 Nov. 4, 2010

Related U.S. Application Data

(60) Provisional application No. 61/174,668, filed on May 1, 2009.

(51) Int. Cl.
*E21B 19/16* (2006.01)
*B25B 5/14* (2006.01)

(52) U.S. Cl. ..... 294/102.2; 294/197

(58) Field of Classification Search ..... 294/90, 294/102.2, 197, 103.1, 104, 902; 81/57.16, 81/57.18, 57.19, 57.21, 57.34; 166/380, 166/77.51, 85.5
See application file for complete search history.

(56) References Cited

U.S. PATENT DOCUMENTS

| | | | | |
|---|---|---|---|---|
| 3,937,514 | A * | 2/1976 | Langowski | 294/88 |
| 4,402,239 | A | 9/1983 | Mooney | |
| 4,441,749 | A * | 4/1984 | Blaschke et al. | 294/88 |
| 4,494,425 | A | 1/1985 | Shewmake, Sr. | |
| 5,702,139 | A | 12/1997 | Buck | |
| 2009/0014169 | A1 * | 1/2009 | Bouligny et al. | 166/77.52 |

* cited by examiner

*Primary Examiner* — Paul T Chin
(74) *Attorney, Agent, or Firm* — Sheema Khan; Miltons IP/p.i.

(57) ABSTRACT

A backup tong that comprises an activating mechanism for advancing a jaw die mounted on a jaw carrier within the backup into engagement with a pipe positioned centrally therein. The jaw carrier is fitted within the tong body to permit a sliding action radially toward the center point of the opening in the backup tong. Such mechanism includes a cam surface located along a first extension of a cam arm which pivots around a fixed pivot pin carried by the body of the backup. The other extension of the cam arm is connected toward its outer end to an actuator, anchored at one end to the backup body and oriented at the other end to swing the cam arm about the pivot pin.

15 Claims, 9 Drawing Sheets

CAM ARM ACTUATED BACKUP TONG

FIELD OF THE INVENTION

This invention relates to power tongs used for the make-up or break-out of tubular materials.

BACKGROUND TO THE INVENTION

When drilling, as in the oil industry, a power tong and backup combination is commonly used to effect a connection between one pipe and another. In order to "makeup" or "break-out" a connection between pipe sections during drilling, it is necessary to hold or clamp the collar or body of the receiving pipe so that it will remain stationary while the other pipe is rotated into engagement with the stationary pipe. This function is done by the use of a "backup tong", often called simply a "backup".

Generally, but not exclusively, the backup is located below the main rotary tong. A backup may be C-shaped, fully closed, or initially open prior to gripping, but closed during gripping, as for example in U.S. Pat. No. 5,702,139 (Buck). The backup is normally hydraulically operated (other methods include pneumatic and manual operation) and due to the nature of its function it is desirable that it be as simple as possible in design. The design of a backup generally includes a set of two or more jaws; a means for connecting the backup to the rotary tong; and provision to make a connection to a rigid anchor point in order to absorb the reaction torque on the stationary pipe arising from the torque applied to the rotating pipe by the rotary tong.

Typically, but not exclusively, on a well site a rotary tong/backup assembly is moved into place so that the backup can grasp the stationary pipe. After centering the stationary pipe in the central opening of the backup, the backup is activated to move its jaws into engagement with the pipe. The jaws bite into the pipe to provide sufficient radial force to overcome the tangential force generated by the torque of the rotary tong. Once the stationary pipe is held in place by the backup, the rotary tong provides torque to the rotating pipe in order to make up the joint. The applied torque builds up until the joint is closed. Once the connection is torqued to its final target value, the backup jaws are released from the anchor and retracted from the stationary pipe.

A common form of backup usually includes one or more cylinders (operated either hydraulically or pneumatically), each of which drive a jaw, either directly or indirectly, along a guided slot radially toward the pipe until a sufficient clamping force is attained. This form of backup generally includes a fixed jaw that reacts against this force and serves to center the pipe; along with the aforementioned driving jaw(s).

References herein to "jaws" may be taken as referring to the combined assembly of the jaw carrier and the die that is carried into contact with the pipe, unless the context indicates otherwise.

A number of desired characteristics of a backup tong include: a sufficient clamping force that holds the stationary pipe while torquing; a limit in size and weight to allow the unit to be used on smaller rig floors and/or snubbing baskets; allow the use of jaws which are interchangeable with the tong, thereby reducing the number of spare jaws required to be stocked by the operator; allow the use of wraparound dies; reduce the quantity of parts thereby reducing cost and inventory; optimize the speed with which the jaws engage the stationary pipe while ensuring that the desired maximum torque can be achieved and supported; and generate a controlled radial force required to grip the pipe while minimizing the hydraulic pressure requirement and avoid crushing of the pipe itself.

U.S. Pat. No. 4,494,425 (Shewmak Sr.) discloses a backup tong wherein a moveable jaw is carried at the end of a lever arm that pivots about a pivot point. The end of the lever arm remote from the jaw is actuated by an air cylinder, causing the jaw at the other end to swing in an arc towards contact with a pipe. The pivot axis is eccentric to a curved face of the moveable jaw, so that as the moveable jaw is swung towards the pipe the jaw closes on the pipe. A disadvantage of this configuration is that the jaw, as it advances further towards the pipe once contact is made, tends to move transversely across the face of the pipe.

U.S. Pat. No. 4,402,239 (Mooney) discloses a backup tong wherein the jaw is carried on a jaw carrier that slides radially towards the pipe to be engaged. The jaw carrier is driven into engagement with the drill pipe by one end of a lever that pivots about a pivot point fixed with respect to the tong body, the other end of the lever being coupled to a hydraulically-driven push rod. In this configuration no provision is made for having distinct rates of advancement of the jaw towards the pipe as the lever rotates about its pivot point. Additionally, the radial force generated is purely based on the differential between the pivot point to cylinder attachment, and the pivot point to roller contact point.

In the aforementioned prior art references, the radial force provided by the jaws will vary to some degree, depending on the state of the pipe, which is often oversize or worn.

Accordingly, it would be desirable to provide a backup tong wherein provision is made for having distinct rates of advancement of the jaw towards the pipe as an activating lever is being rotated in order to effect engagement of the jaw with such pipe. It would also be desirable to provide for a design option for controlling the amplification factor for the force originating from an actuator and giving rise to the force being applied by a jaw to the pipe.

SUMMARY OF THE INVENTION

In one aspect of the present invention, there is provided a backup tong comprising: a body with a central opening for receiving a tubular body; a fixed jaw assembly mounted on the backup tong body for engagement with the tubular body; a sliding jaw assembly mounted on the backup tong body for sliding engagement with the tubular body; an activating mechanism for slidingly advancing the sliding jaw assembly onto engagement with the tubular body positioned centrally within the opening, the activating mechanism comprising: (a) a cam arm which pivots around a fixed pivot point on the body of the backup tong, the cam arm comprising a first extension and second extension; the first extension having a cam surface in contact with the sliding jaw assembly thereby defining a point of contact on the cam surface; the cam surface comprising a rapid surface portion for rapid advancement of the sliding jaw assembly and a slow surface portion for slow advancement of the sliding jaw assembly; and (b) an actuating mechanism for providing rotation of the cam arm about the pivot point, the actuating mechanism mounted on the tong body and connected to the second extension; wherein upon rotation of the cam arm by the actuating mechanism, the point of connection first traverses along the rapid surface portion and then the slow surface portion, resulting in rapid advancement of the sliding jaw assembly upon initial approach towards the tubular body, followed by slow advancement of the sliding jaw assembly upon close approach and engagement with the tubular body.

In another aspect of the present invention, there is provided a backup tong comprising: a body with a central opening for receiving a tubular body; a first sliding jaw assembly mounted on the backup tong body for sliding engagement with the tubular body; a first activating mechanism for slidingly advancing the first jaw assembly onto engagement with the tubular body positioned centrally within the opening; a second sliding jaw assembly mounted on the backup tong body for sliding engagement with the tubular body; a second activating mechanism for slidingly advancing the second jaw assembly onto engagement with the tubular body positioned centrally within the opening; each activating mechanism comprising: a cam arm which pivots around a first fixed pivot point on the body of the backup tong, the cam arm comprising a first extension and second extension; the first extension having a cam surface in contact with the respective sliding jaw assembly thereby defining a point of contact on the cam surface; the cam surface comprising a rapid surface portion for rapid advancement of the respective sliding jaw assembly and a slow surface portion for slow advancement of the respective sliding jaw assembly; and an actuating mechanism for providing rotation of the cam arm about the pivot point, the actuating mechanism mounted on the tong body and connected to the second extension; wherein upon rotation of the cam arm by the actuating mechanism, the point of connection first traverses along the rapid surface portion and then the slow surface portion, resulting in rapid advancement of the respective sliding jaw assembly upon initial approach towards the tubular body, followed by slow advancement of the respective sliding jaw assembly upon close approach and engagement with the tubular body.

According to one embodiment of the invention a backup comprises an activating mechanism for advancing a jaw die mounted on a jaw carrier within the backup into engagement with a pipe positioned centrally therein. The jaw carrier is fitted within the tong body to permit a sliding action radially toward the center point of the opening in the backup tong. Such mechanism includes a cam surface located along a first extension of a cam arm which pivots around a fixed pivot pin carried by the body of the backup. The other extension of the cam arm is connected toward its outer end to an actuator (for example, a hydraulic cylinder), anchored at one end to the backup body and oriented at the other end to swing the cam arm about the pivot pin.

The cam surface is located along an edge-face portion of the first extension of the cam arm so as to present the cam surface for connecting with a portion of a jaw carrier. The cam surface may connect with the jaw carrier on the end of the jaw carrier remote from the pipe or through any other portion of the jaw carrier that will permit the jaw carrier to move in response to movement of the cam surface. Rotation of the cam arm changes the point of connection between the jaw carrier and the cam surface, resulting in the advancement of the jaw carrier towards the pipe.

Just as the jaw engages the pipe (and subsequently tightens the engagement), the point of connection between the jaw carrier and the cam surface tends to move nearly, but not precisely, transversely across the face of the cam surface with further rotation of the cam arm.

The shape of the cam surface in this region is chosen so as to provide a selected amplification factor for the force originating from the actuator and giving rise to the force being applied by the jaw to the pipe.

The cam surface may further be provided with a profile which includes two portions: a first portion for advancing the jaw carrier rapidly towards the pipe at it approaches engagement, and a second portion for advancing the jaw carrier more slowly towards the pipe in the terminal stage of its engagement (i.e. gripping), based on a constant speed of advancement of the actuator. This distinction in the portions of the cam surface allows the invention to achieve distinct rates of advancement of the jaw towards the pipe.

During the approach stage of jaw engagement, there is relatively little resistance to advancement of the jaw carrier. However, during the gripping stage of engagement (i.e. when the jaw is in contact with the pipe), substantial resistance will be encountered. If the actuator is a hydraulic cylinder, the hydraulic pressure will approach a maximum as the jaw contacts the pipe. Advancement of the jaw at this stage is limited to the engagement of serrations on the gripping face of the jaw with the outside surface of the pipe, and the compression and the deflection of the components transporting the driving force to the jaw-pipe interface, and to deformation of the pipe itself.

Control of this force is critical due to the possibility that it may deform the pipe beyond its elastic limit and therefore make the pipe out-of-round.

The orientation of the two portions of the cam surface with respect to the direction of a radial line (which extends from the center of the tong outwardly through the jaw carrier and also defines the direction of travel of the jaw carrier), can be measured by a "cam angle", defined as the angle between the radial line and the tangent to the connection point between the jaw carrier and the cam surface. The cam angle at the fast portion of the cam surface is much less than the cam angle along the slow portion of the cam surface. Alternately, the tangent to the connection point along the slow portion of the cam surface, is more transverse to the radial line, than the tangent to the connection point along the fast portion of the cam surface.

The smaller the cam angle between the radial line and the tangent to the fast cam surface portion at the point of jaw carrier connection, the faster the jaw will advance from the retracted position as the cam arm is rotated. Since the maximum angular travel of the cam arm itself under actuation is typically about 90 degrees, it is desirable to shape a cam profile which progressively decreases the cam angle along the extent of the fast cam region, in order to avoid undue limitations on the available length of the slow cam surface. The transition area between the fast and slow cam surfaces may be shaped to include a radius in the transition surface.

The length of the respective extensions of the cam arm, and the profile of the slow cam surface portion collectively control the degree to which the force applied by the cam arm actuator is multiplied as the final compressive force is applied at the jaw-pipe interface. When the profile of the slow cam surface portion is shaped to allow the cam angle to progressively become more nearly aligned fully transverse to the radial line passing through the jaw carrier, the degree of amplification of force is also progressively increased along the path of jaw carrier travel. If the slow cam surface is aligned fully transverse to the radial line, the advancement of the jaw into the pipe with the rotation of the cam arm would ultimately cease altogether. If, by this point, the jaw has not fully advanced into a non-slipping engagement with the pipe, the backup will fail to achieve its purpose. The slow cam surface portion must therefore be shaped such that the its surface contour has a cam angle oriented along a line that that is relatively close to, but not fully transverse to the radial line, in order to ensure the jaw's continued advancement while providing an appropriate amplification factor for force. Accordingly, the working profile of the slow cam surface is a sensitive variable for the proper operation of this backup.

The slow cam surface portion of the cam arm may be advantageously, but not necessarily, shaped to provide a greater cam angle than that of the fast cam surface portion, with respect to the radial line of jaw carrier travel, in order to provide greater force amplification and a slower jaw closing speed relative to the work pipe. Slow cam surface angles very close to tangential to the radial line may create high resultant forces on the driving jaw, and may also result in a self-locking cam condition, wherein the cam becomes difficult to break free upon jaw retraction.

Smaller slow cam angles provide a lesser mechanical advantage, and at lower angles the resultant forces on the driving jaw could prove too low to create a useful pressure of the jaw against the pipe. This means that the determination of the optimal range of slow cam surface tangent angles requires balancing sufficient force for useful jaw grip on a pipe against the development of excessive jaw forces that can crush or otherwise damage the pipe and potentially lock-up the backup tong.

Within the above angular range considerations, a nearly linear contour with a constant cam angle on the slow cam surface will allow the jaw to move inwardly at a nearly constant rate as the cam arm is rotated by advancement of the actuator at a constant speed. In this case however, the resultant force on the jaw roller will change dynamically during cam arm travel, due to the progressive change of the angle between the applied actuator force and the cam arm, with the jaw roller force being greatest when the actuator force is perpendicular to the cam arm. This variation in transmitted jaw roller force can be mitigated by shaping the slow cam surface contour as a continuous curve that accommodates and counteracts such driving force variations.

The transition point between jaw-approaching fast cam surface and the pipe-gripping slow cam surface portions should preferably be set to engage with the jaw carrier just as the jaw is arriving at the pipe. The length of the slow cam surface portion should be sufficient to ensure that, with further rotation of the cam arm, the jaw will become fully engaged with the pipe with adequate gripping force to secure it.

In the preferred design case where the slow cam surface, defined by its tangent cam angles, is not aligned fully transversely to the radial line but is approaching this limit, the operator should take care to limit the force being generated by the cam arm actuator, in order to prevent the application of damaging excessive radial force to an engaged pipe.

In the above summary a mechanism for advancing a single jaw towards pipe has been described. The invention is applicable to a case where the backup has two jaws, one fixed, and one displaceable. In such case, the fixed jaw would be shaped and positioned to be centrally aligned with the center of pipe to be gripped. It is also possible to include two or more actuated jaws in a backup, there being independent actuators provided for each of the actuated jaws.

To reduce friction, it is preferable that the portion of the actuated jaw's carrier that connects with the cam surface be provided with a friction-reducing cam follower or roller. This can be in the form of a roller fitted to the jaw carrier. The point of contact between the cam surface and roller is preferably close to, or directly on the radial line, in order to minimize sideways forces on the jaw carrier.

The cam arm backup according to the invention advantageously provides programmed rates of advancement of the jaw along its travel towards the pipe and during engagement. It also provides for a design option for deterministic control of the amplification factor giving rise to optimum forces being applied by a jaw to a pipe.

Due to the simplicity of the design and the low number of parts used, the cam arm backup may be constructed so as to be of reduced size and weight when compared to many other typical backup units. Additionally, the cam arm actuating system of the invention allows two simple jaws to be used for the clamping action, rather than the traditional three. This allows the use of specialized dies, as well as permitting the dies to be used in an open mouth backup without the need for the door which is traditionally used to house a jaw in three jaw backups relying on a mechanical advantage. Further, the use of the cam allows a variable amplification of force and speed permitting the use of smaller bore actuating cylinders of reduced stroke.

Generally the reduced size of the jaw assemblies will avoid the requirement for a jaw retraction mechanism, as the smaller jaws are easily displaced by the pipe as it is moved into place or removed. However in alternate embodiments the jaws may be either retracted by the actuator or fitted with an independent retraction method mounted between the backup and the jaw.

The invention in its general form will first be described, and then its implementation in terms of specific embodiments will be detailed hereafter. These embodiments are intended to demonstrate the principle of the invention, and the manner of its implementation. The invention in its broadest and more specific forms will then be further described, and defined, in each of the individual claims which conclude this Specification.

The foregoing summarizes the principal features of the invention and some of its optional aspects. The invention may be further understood by the description of the embodiments which follow,

Figure 1:
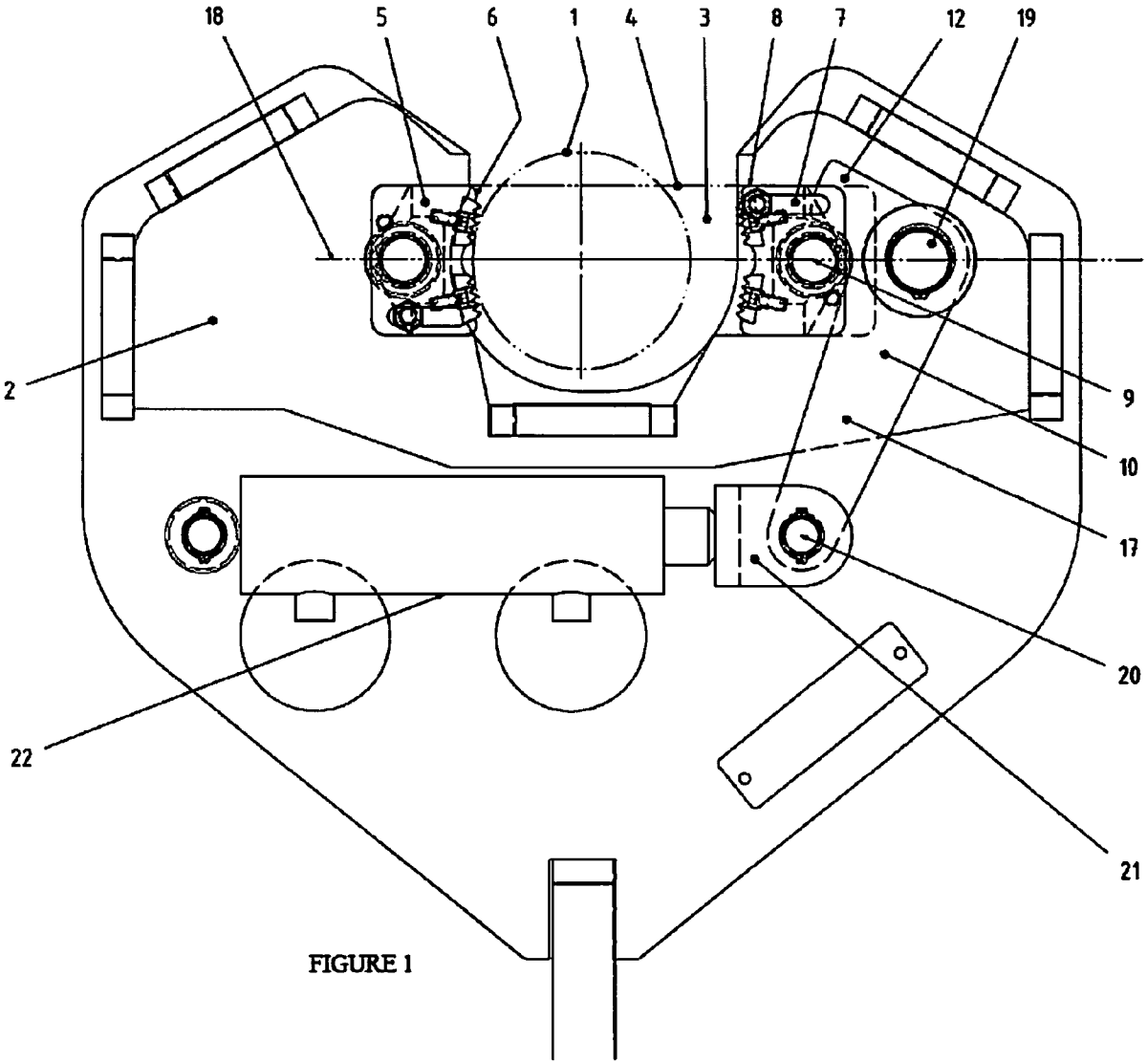
FIG. 1 is a plan view of a backup tong with a driving jaw in the retracted position, and top plate removed.

The following is given by way of illustration only and is not to be considered limitative of this invention. Many apparent variations are possible without departing from the spirit and scope thereof.

DESCRIPTION OF THE PREFERRED EMBODIMENT

As shown in the FIGS. 1-4, a backup tong has a body 2 with a central opening 3 and a throat 4. The tong body 2 is moved into position around pipe 4. Central opening 3 is preferably C-shaped. Attached to the top of tong body 2 at one side of the central opening 3 is a stationary jaw carrier 5, which projects into the central opening 3 such that stationary jaw 6 can be placed into contact with centrally-positioned pipe 1.

At the opposite side of central opening 3, a second complimentary driving jaw carrier 7 is positioned to allow radial motion with respect to tong body 2. Driving jaw 8 makes contact with pipe 1 as jaw carrier 7 is advanced towards pipe 1. Cam-following roller 9, which runs against the contoured edge face 13 of cam arm 10, is mounted at the distal end of jaw carrier 7.

As shown in FIG. 1, cam arm 10 is rotatably mounted on a fixed pivot pin 19 secured to tong body 2. Fixed pivot pin 19 and cam following roller 9 are disposed along a radial line 18 that extends from the center of tong body opening 3 through the driving jaw carrier 7. Driving jaw 8 travels along radial line 18.

Figure 5:
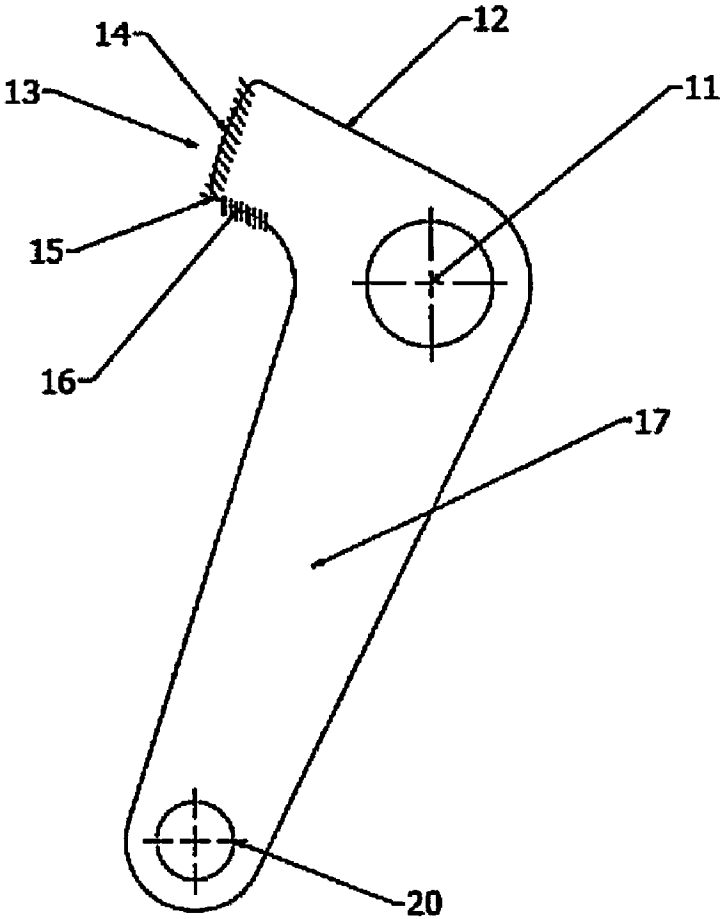
FIG. 5 is a detailed plan view of a cam arm.

As shown in FIG. 5, cam arm 10 is generally angular in shape, with two extensions projecting from its pivot point 11. The first cam arm extension 12 has an edge face 13 upon which is formed the cam surface which bears against jaw roller 9. The edge face 13 is shaped into three distinct cam surfaces 14, 15 and 16.

Figure 6:
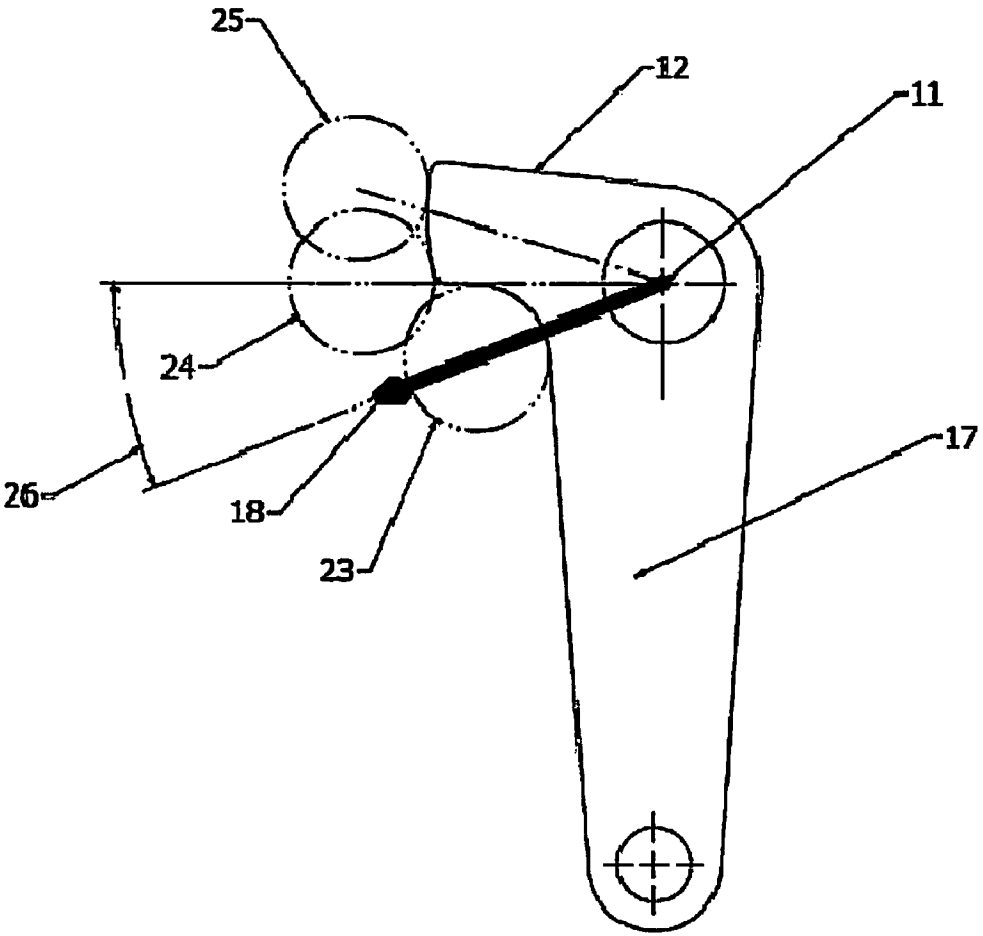
FIG. 6 is a detailed plan view of a cam arm showing the respective orientations of a cam following roller as it progresses along cam surfaces.

Referring to FIGS. 5 and 6, it can be seen that the first cam surface 16 (or "fast cam surface") is characterized by a relatively low cam angle (defined previously as the angle between the tangent at the point of connection relative and the radial line 18). The second cam surface 15 (or the "transition cam surface") then leads into the third cam surface 14 (or "slow cam surface"), which has a higher cam angle.

As shown in FIGS. 1-4, the second extension 17 of cam arm 10 is attached by drive linkage 20 to hydraulic piston rod 21, and serves as the effort arm of the lever composed of cam arm 10 across the fulcrum of pivot pin 19. Hydraulic cylinder 22 serves as a linear actuator to drive this lever and thus operate the backup tong's jaw mechanism.

Figure 2:
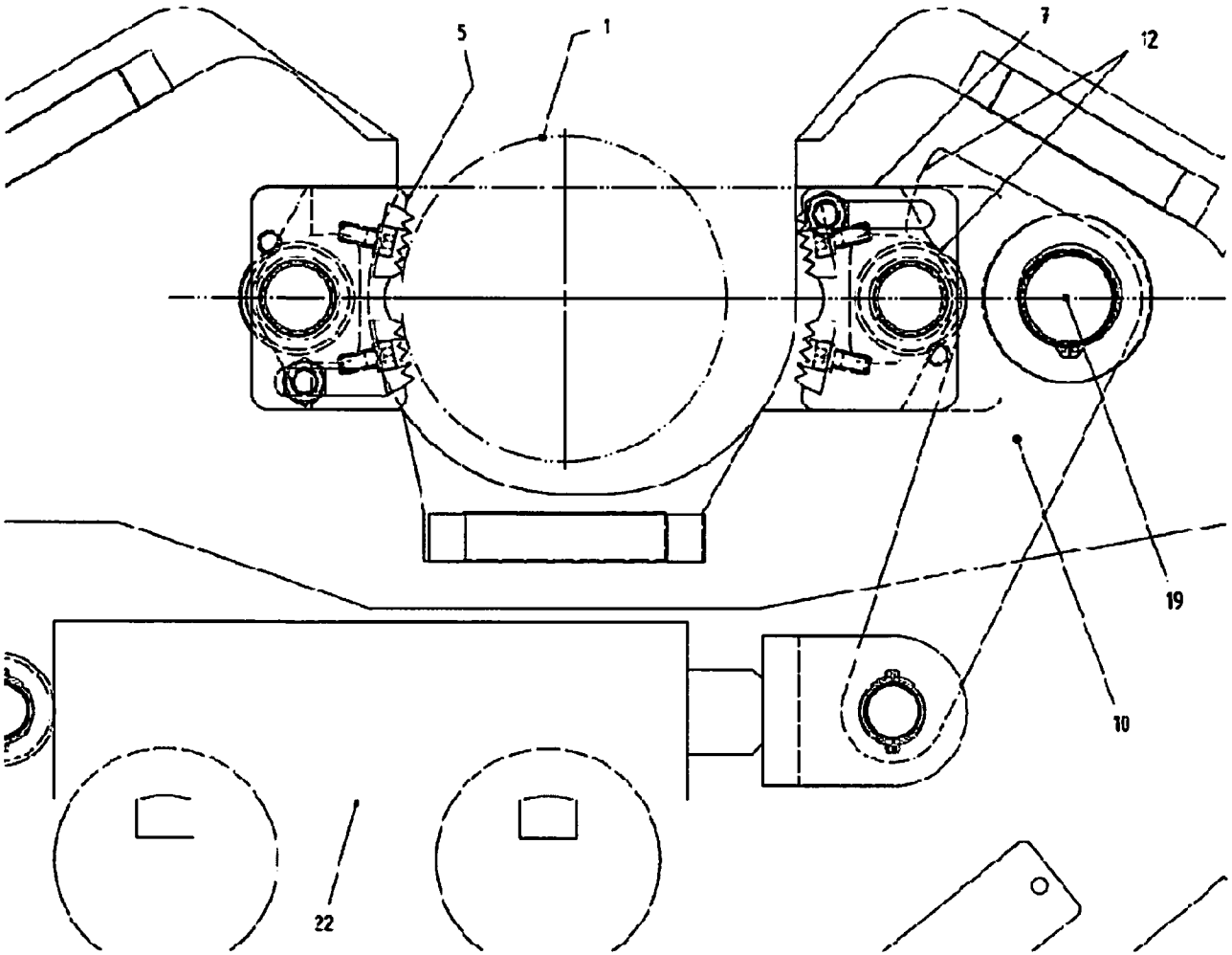
FIG. 2 is a detailed plan view of a backup tong jaw mechanism in the retracted position.

FIGS. 1 and 2 show the backup tong positioned to begin engagement with pipe 1. Here the tong body 2 has been placed such that stationary jaw 6 is in contact with the pipe; piston rod 21 is fully retracted into hydraulic cylinder 22, which places cam arm 10 in its starting position; and the driving jaw carrier 7 is at its furthest point of retraction.

Figures 7, 8, 9:
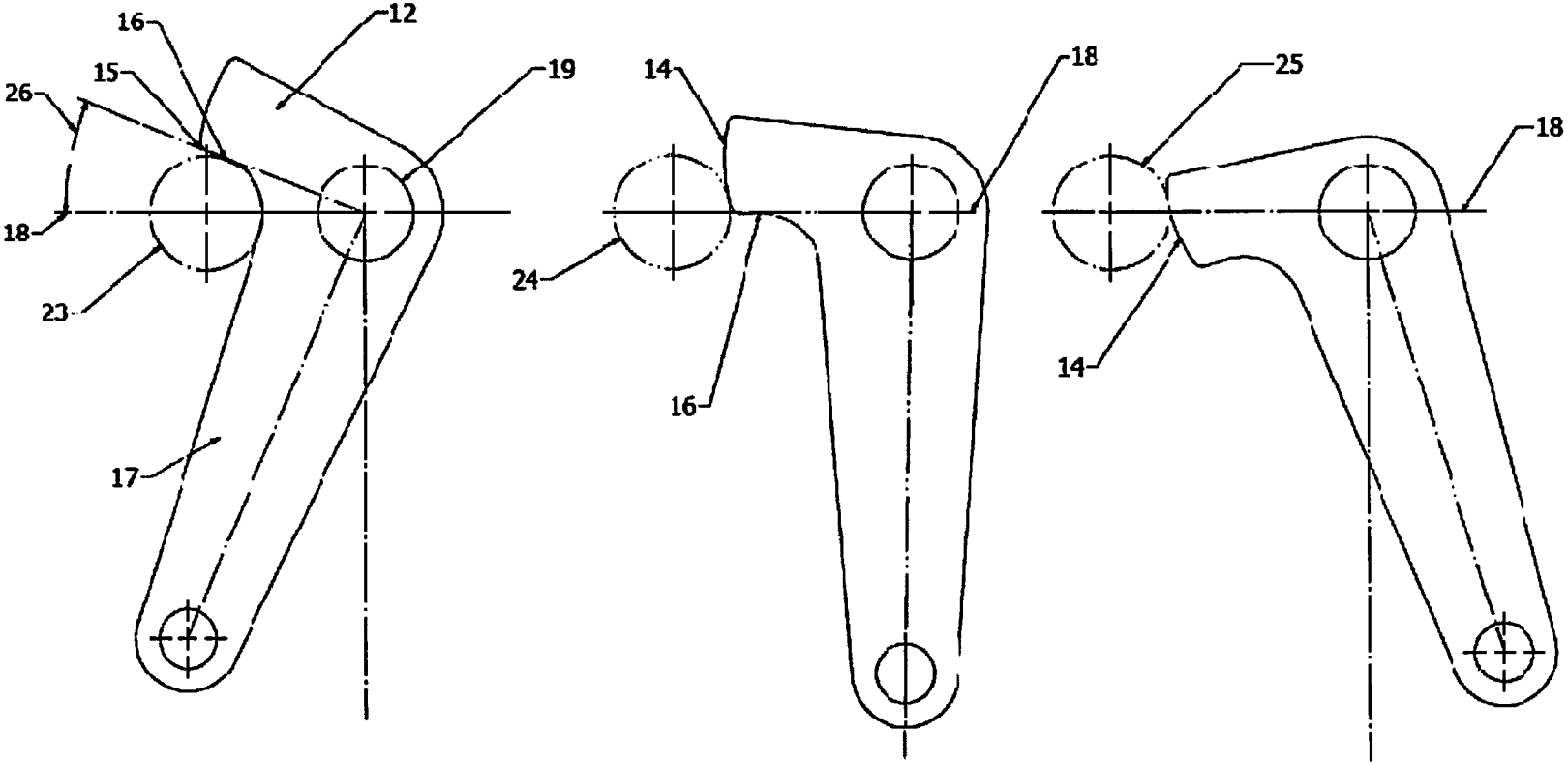
FIG. 7 is a detailed plan view of a cam arm showing the position of a cam following roller in the starting, fully retracted position.
FIG. 8 is a detailed plan view of the cam arm of FIG. 7 showing the position of the cam following roller at a transition point between fast and slow cam surface.
FIG. 9 is a detailed plan view of the cam arm of FIG. 7 showing the position of the cam following roller at the end of the slow cam surface.

As shown in FIGS. 6 and 7, cam arm 10 is thus in its starting position, with the onset point of fast cam surface 16 lying along radial line 18, and the cam following jaw roller 9 is in contact with fast cam surface 16 at its retracted starting position 23.

When hydraulic cylinder 22 is pressurized, piston rod 21 is driven outwardly from the cylinder and expresses force against cam arm drive linkage 20. This driving force induces cam arm 10 to rotate about pivot pin 19 such that the fast cam surface 16 begins to act against jaw roller 9.

Referring to FIG. 7, as jaw roller 9 moves from its starting position 23, it must initially ascend the relatively steep fast cam starting angle 26. Thus, at the outset of motion, the roller 9 and connected jaw carrier 7 move quite rapidly along radial line 18, and the distance between driving jaw 8 and pipe 1 closes quickly. As roller 9 proceeds along fast cam surface 16 to the transition region 15, the angle faced by the roller decreases progressively, and jaw carrier travel begins to slow.

Figure 10:
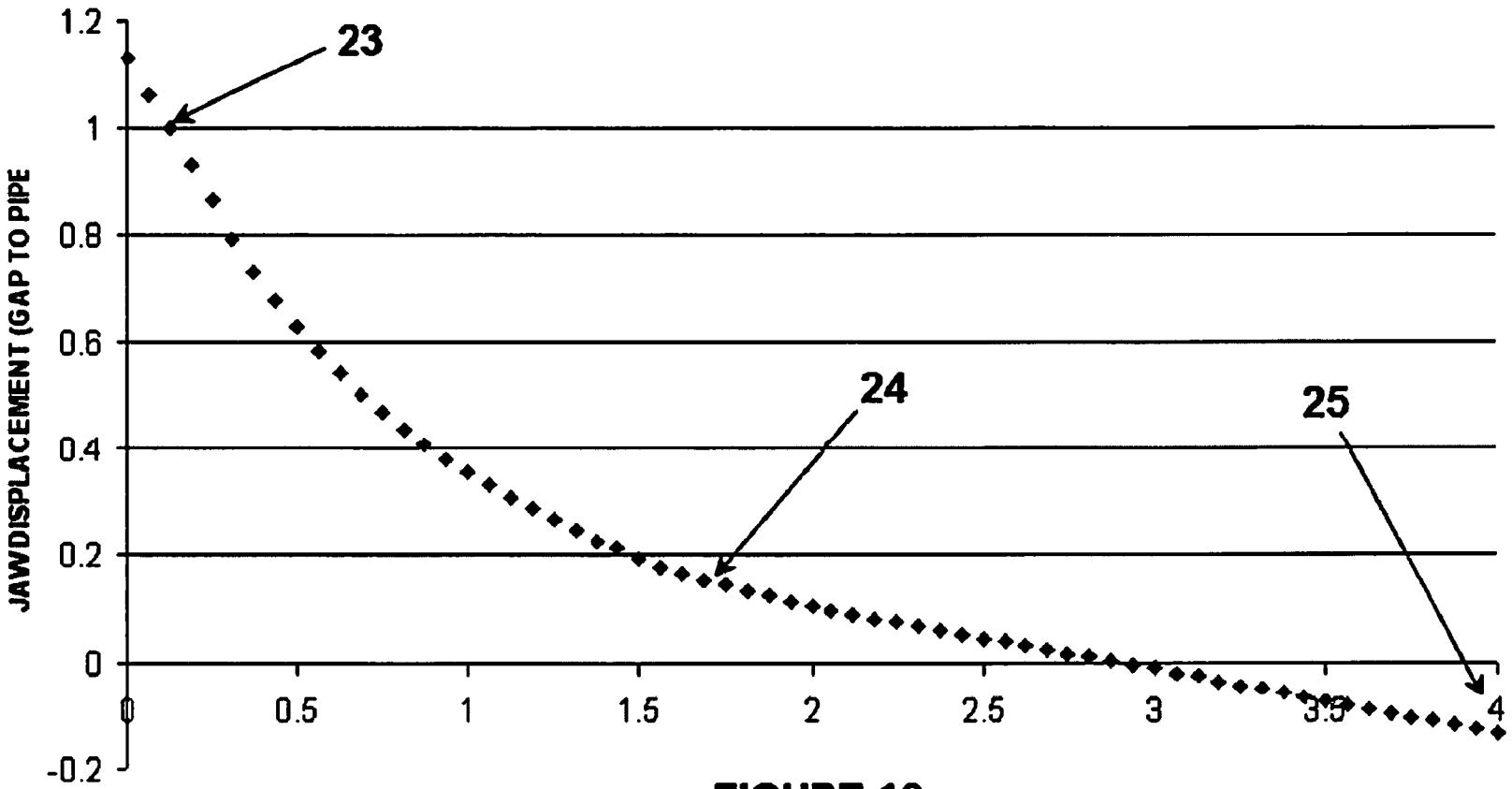
FIG. 10 is a representative graph of a back-up tong's driven jaw displacement plotted against a hydraulic actuator extension.

This slowing can be seen in the representative graph of FIG. 10, which plots the displacement of the driving jaw 8 versus extension of the hydraulic actuator, for a pipe of nominal diameter. The slowing can be seen in FIG. 10 as the gap between driving jaw 8 and the pipe 1 decreases at a declining rate as hydraulic cylinder displacement moves from 0 to about 1.4 inches, at which point the cam surface contact point of roller 9 approaches transition cam surface 15.

As the hydraulic piston rod 21 continues its outward travel from cylinder 22, the longitudinal axis of the cam arm's second extension 17 preferably approaches an orientation approximately perpendicular to radial line 18, advancing the cam surface contact point of jaw roller 9 across the transition cam surface 15. At the point when the cam arm's second extension 17 has reached approximate perpendicularity to radial line 18, jaw roller 9 has attained its slow cam starting position 24, as can be seen in FIGS. 6 and 8, and on the graph of FIG. 10 at about 1.7 inches of hydraulic cylinder displacement.

Figure 3:
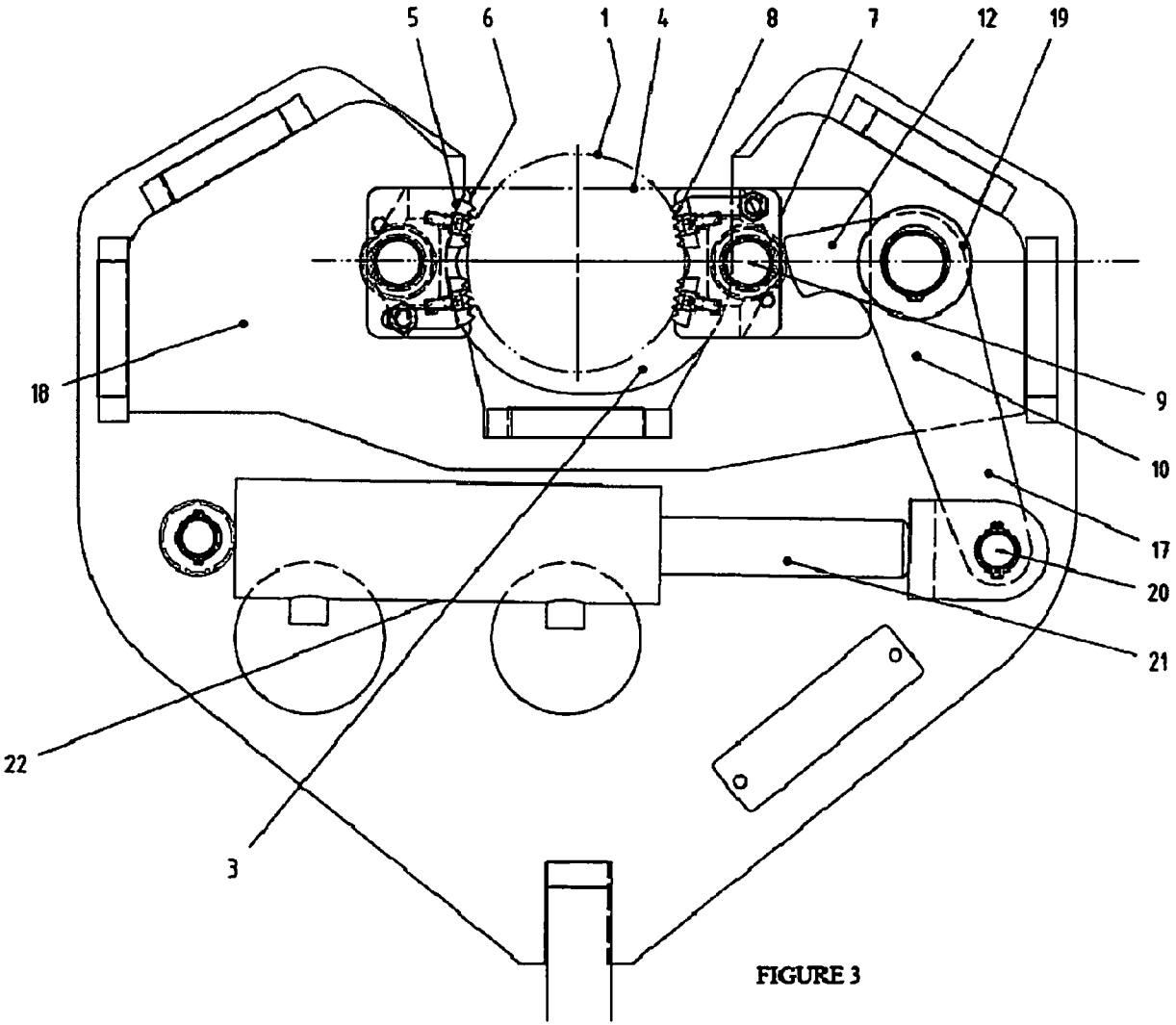
FIG. 3 is a plan view of a backup tong, with a driving jaw extended in clamping engagement with a pipe.
Figure 4:
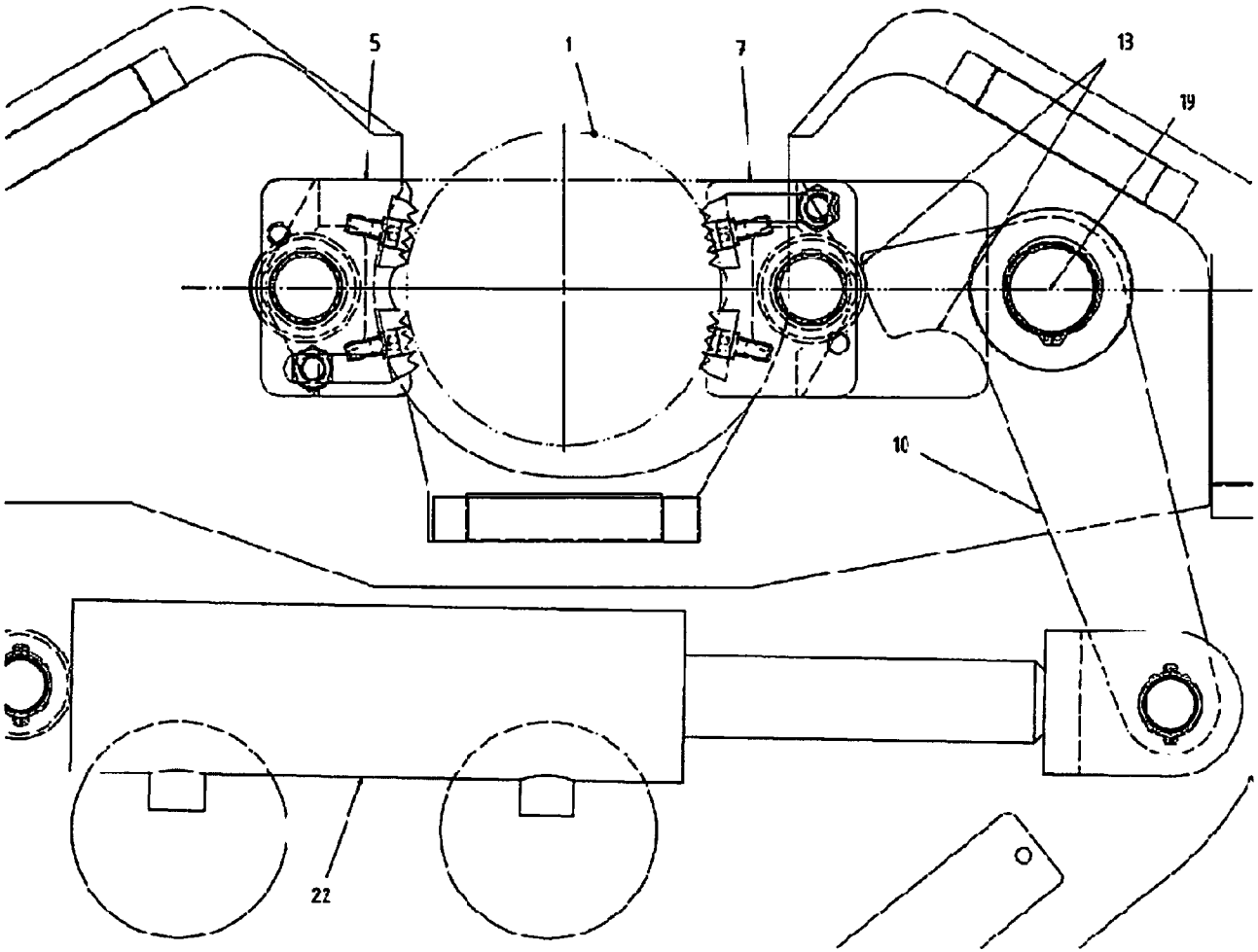
FIG. 4 is a detailed plan view of a backup tong jaw mechanism, with a driving jaw extended in clamping engagement with a pipe.

With reference to FIGS. 3 and 8, it can be seen that with continued driving force applied by hydraulic piston rod 21, and with the cam arm extension 17 approximately perpendicular to radial line 18, the resultant force on roller 9 derived from the lever of cam arm 10 against pivot pin 19 will reach its maximum range. The lower rate of advancement of the contact point between the slow cam surface 14 and the jaw roller 9 causes a concomitant reduction in the travel rate of the jaw carrier 9 along radial line 18. As cam arm extension 17 continues to rotate, its longitudinal angle with respect to radial line 18 grows beyond the optimal power transfer altitude of 90 degrees off the radial line 18 depicted in FIG. 8. To mitigate the decrease in resultant force against jaw roller 9, the contour of slow cam surface 14 is shaped to progressively reduce the cam angle as the jaw roller proceeds along, thus allowing a continuance in the application of high resultant force on jaw roller 9. The compensating effect of this contoured progressive reduction in the angle of attack of slow cam surface 14 can be seen in the representative graph of FIG. 10, with a relatively linear decrease in jaw separation from the pipe along the section of the domain from about 1.7 inches to about 4.0 inches of hydraulic cylinder displacement. At this terminal point of travel, cam arm 10 has reached the orientation illustrated in FIGS. 6 and 9, and jaw roller 9 has attained limit position 25.

At this limit point 25, and as jaw roller 9 travels further along slow cam surface 14 beyond this point, there will be no further advancement of the jaw carrier 7, and no further increase in the gripping force applied to pipe 1.

Figure 11:
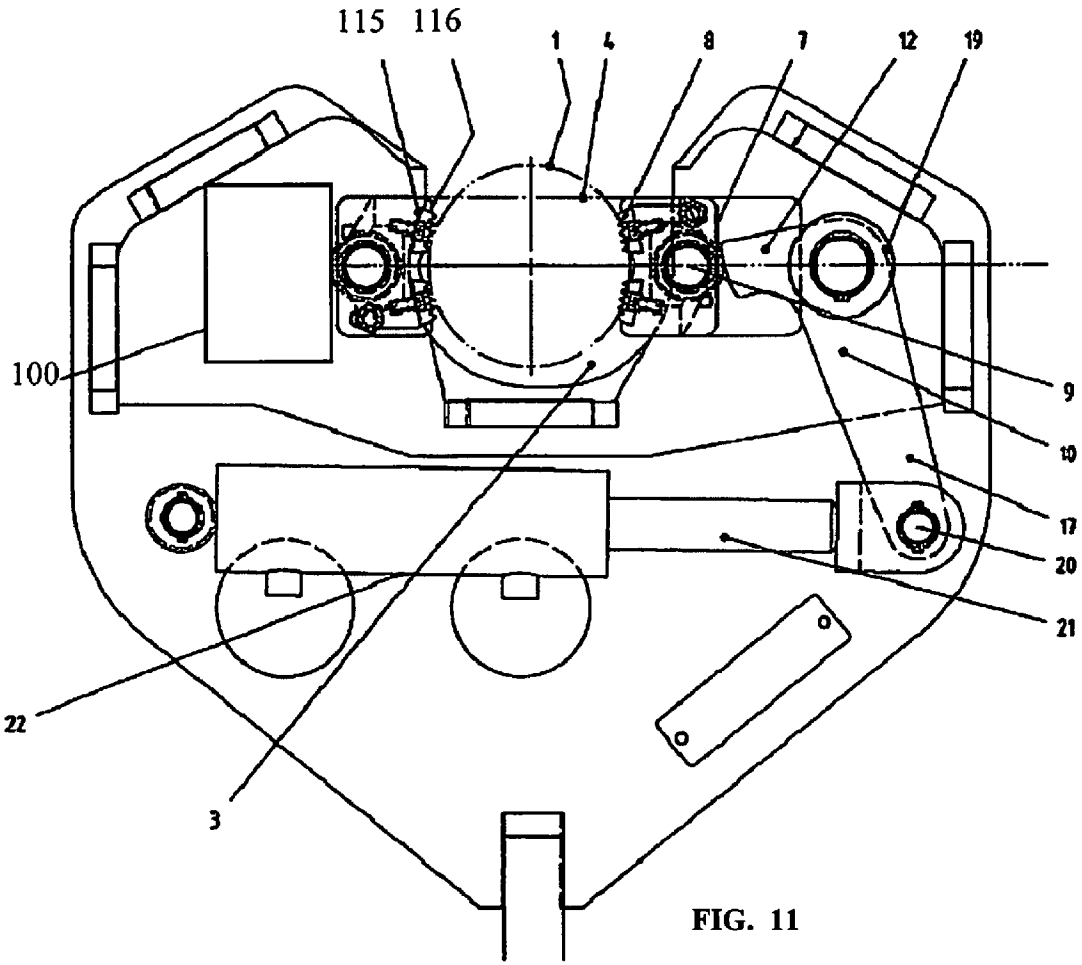
FIG. 11 is a plan view of a backup tong, with two actuated jaws in clamping engagement with a pipe.

FIG. 11 illustrates an embodiment with two actuated jaws in a backup, with independent actuators provided for each of the actuated jaws. First and second sliding jaw assemblies (110, 120) are mounted on the backup tong body for sliding engagement with the pipe (1). The first sliding jaw assembly (110) is identical to that shown in FIG. 3, and so identical reference numerals are used. The first sliding jaw assembly includes the driving jaw carrier (7) and driving jaw (8). Similarly, the first activating mechanism for slidingly advancing the first sliding jaw assembly, is identical to that shown in FIG. 3, and so, identical reference numerals are used.

The second sliding jaw assembly (120) and the second activating mechanism (118) have the same basic components as the first sliding jaw assembly (110) and the first activating mechanism, respectively. For example, the second sliding jaw assembly (120) includes a second complimentary driving jaw carrier (115) and driving jaw (116) which makes contact with pipe (1) as jaw carrier (115) is advanced towards pipe (1). The second activating mechanism (118) slidingly advances the second sliding jaw assembly (120) in an identical manner as the first activating mechanism acts first sliding jaw assembly (110).

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The invention claimed is:

1. A backup tong comprising:

a body with a central opening for receiving a tubular body;

a fixed jaw assembly mounted on the backup tong body for engagement with the tubular body;

a sliding jaw assembly mounted on the backup tong body for sliding engagement with the tubular body;

an activating mechanism for advancing the sliding jaw assembly onto engagement with the tubular body positioned within the opening, the activating mechanism comprising:

(a) a cam arm which pivots around a fixed pivot point on the body of the backup tong, the cam arm comprising a first extension and second extension; the first extension having a cam surface on an edge face portion thereof, the cam surface in contact with the sliding jaw assembly thereby defining a point of contact on the cam surface; the cam surface comprising a rapid surface portion for rapid advancement of the sliding jaw assembly and a slow surface portion for slow advancement of the sliding jaw assembly; and (b) an actuating mechanism for providing rotation of the cam arm about the pivot point, the actuating mechanism mounted on the tong body and connected to the second extension;

wherein upon rotation of the cam arm by the actuating mechanism, the point of connection first traverses along the rapid surface portion and then the slow surface portion, resulting in rapid advancement of the sliding jaw assembly upon initial approach towards the tubular body, followed by slow advancement of the sliding jaw assembly upon close approach and engagement with the tubular body.

2. The backup tong as in claim 1, wherein the slow surface portion is shaped such that a tangent to the connection point along the slow surface portion remains approximately transverse to a line of advancement of the sliding jaw assembly.

3. The backup tong as in claim 1, wherein the rapid surface portion and slow surface portion respectively provide a selected first and second portion amplification factor of a force originating from the actuating mechanism, the second portion amplification factor being greater than the first portion amplification factor.

4. The backup tong of claim 1, wherein the sliding jaw assembly comprises a jaw mounted on a jaw carrier and the cam surface is in contact with the jaw carrier.

5. The backup tong of claim 1, wherein the sliding jaw assembly comprises: a jaw mounted on a jaw carrier; a cam follower disposed between the jaw carrier and the cam surface, with the cam surface in contact with the cam follower.

6. The backup tong of claim 5, wherein a centre of the pivot point is aligned with a radial line when the connection point travels along the slow surface portion; the radial line extending radially from a center of the central opening to jaw assembly.

7. The backup tong of claim 1, wherein the actuating mechanism is a hydraulic cylinder.

8. The backup tong of claim 1, further comprising a second sliding jaw assembly activated by a second activating mechanism.

9. A backup tong comprising:

a body with a central opening for receiving a tubular body;

a first sliding jaw assembly mounted on the backup tong body for sliding engagement with the tubular body;

a first activating mechanism for advancing the first jaw assembly onto engagement with the tubular body positioned centrally within the opening;

a second sliding jaw assembly mounted on the backup tong body for sliding engagement with the tubular body;

a second activating mechanism for advancing the second jaw assembly onto engagement with the tubular body positioned centrally within the opening;

each activating mechanism comprising:

(c) a cam arm which pivots around a first fixed pivot point on the body of the backup tong, the cam arm comprising a first extension and second extension; the first extension having a cam surface in contact with the respective sliding jaw assembly thereby defining a point of contact on the cam surface; the cam surface comprising a rapid surface portion for rapid advancement of the respective sliding jaw assembly and a slow surface portion for slow advancement of the respective sliding jaw assembly; and (d) an actuating mechanism for providing rotation of the cam arm about the pivot point, the actuating mechanism mounted on the tong body and connected to the second extension;

wherein upon rotation of the cam arm by the actuating mechanism, the point of connection first traverses along the rapid surface portion and then the slow surface portion, resulting in rapid advancement of the respective sliding jaw assembly upon initial approach towards the tubular body, followed by slow advancement of the respective sliding jaw assembly upon close approach and engagement with the tubular body.

10. The backup tong as in claim 9, wherein the slow surface portion is shaped so that a tangent to the connection point at the slow surface portion remains approximately transverse to a line of advancement of the respective sliding jaw assembly, as the cam arm rotates.

11. The backup tong as in claim 9, wherein the rapid surface portion and slow surface portion respectively provide a selected first and second portion amplification factor of a force originating from the actuating mechanism, the second portion amplification factor being greater than the first portion amplification factor.

12. The backup tong as in claim 9, wherein each sliding jaw assembly comprises a jaw mounted on a jaw carrier and the cam surface is in contact with the jaw carrier.

13. The backup tong as in claim 9, wherein each sliding jaw assembly comprises: a jaw mounted on a jaw carrier; a cam follower disposed between the jaw carrier and the respective cam surface, with the cam surface in contact with the cam follower.

14. The backup tong as in claim 13, wherein a centre of the pivot point is aligned with a radial line when the connection point travels along the slow surface portion; the radial line extending radially from a center of the central opening to jaw assembly.

15. The backup tong as in claim 9, wherein the actuating mechanism is a hydraulic cylinder.

* * * * *